US007952012B2

(12) United States Patent
Homburg

(10) Patent No.: US 7,952,012 B2
(45) Date of Patent: May 31, 2011

(54) ADJUSTING A VARIABLE TEMPO OF AN AUDIO FILE INDEPENDENT OF A GLOBAL TEMPO USING A DIGITAL AUDIO WORKSTATION

(75) Inventor: Clemens Homburg, Hamburg (DE)

(73) Assignee: Apple Inc., Cupertino, CA (US)

( * ) Notice: Subject to any disclaimer, the term of this patent is extended or adjusted under 35 U.S.C. 154(b) by 136 days.

(21) Appl. No.: 12/506,111

(22) Filed: Jul. 20, 2009

(65) Prior Publication Data

US 2011/0011244 A1 Jan. 20, 2011

(51) Int. Cl.
*G10H 1/00* (2006.01)

(52) U.S. Cl. ..... 84/612; 84/636; 84/652; 84/668

(58) Field of Classification Search ..... 84/612, 84/636, 652, 668
See application file for complete search history.

(56) References Cited

U.S. PATENT DOCUMENTS

| | | | | |
|---|---|---|---|---|
| 4,876,937 | A * | 10/1989 | Suzuki | 84/612 |
| 4,920,851 | A * | 5/1990 | Abe | 84/626 |
| 5,313,011 | A * | 5/1994 | Koguchi | 84/609 |
| 5,883,326 | A * | 3/1999 | Goodman et al. | 84/649 |
| 5,952,596 | A | 9/1999 | Kondo | |
| 6,316,712 | B1 * | 11/2001 | Laroche | 84/636 |
| 6,977,335 | B2 | 12/2005 | Georges et al. | |
| 7,012,183 | B2 * | 3/2006 | Herre et al. | 84/611 |
| 7,026,536 | B2 * | 4/2006 | Lu et al. | 84/612 |
| 7,078,607 | B2 * | 7/2006 | Alferness | 84/609 |
| 7,081,580 | B2 * | 7/2006 | Brinkman et al. | 84/609 |
| 7,132,595 | B2 * | 11/2006 | Lu et al. | 84/612 |
| 7,183,479 | B2 * | 2/2007 | Lu et al. | 84/612 |
| 7,189,913 | B2 | 3/2007 | Moulios et al. | |
| 7,385,128 | B2 * | 6/2008 | Lawliss et al. | 84/484 |
| 7,518,053 | B1 * | 4/2009 | Jochelson et al. | 84/609 |
| 7,579,546 | B2 * | 8/2009 | Sumita | 84/611 |
| 2005/0211072 | A1 * | 9/2005 | Lu et al. | 84/612 |
| 2005/0235811 | A1 * | 10/2005 | Dukane | 84/612 |
| 2006/0048634 | A1 * | 3/2006 | Lu et al. | 84/612 |
| 2006/0060067 | A1 * | 3/2006 | Lu et al. | 84/612 |
| 2006/0259862 | A1 * | 11/2006 | Adams et al. | 715/716 |
| 2007/0044639 | A1 | 3/2007 | Farbood et al. | |
| 2007/0044641 | A1 * | 3/2007 | McKinney et al. | 84/612 |
| 2007/0180980 | A1 * | 8/2007 | Kim | 84/612 |

(Continued)

OTHER PUBLICATIONS

Steinberg Media Technologies GmbH Product, "Cubase SL3: Professional Music Creation & Production," Available online from Ventura Educational Systems, Grover Beach, CA, http://www.venturaes.com/index_new.asp?http://www.venturaes.com/steinberg/index.html, last visited Sep. 23, 2009.

(Continued)

*Primary Examiner* — David S. Warren
(74) *Attorney, Agent, or Firm* — Jürg L. Domenig; Novak Druce + Quigg LLP

(57) ABSTRACT

A computer implemented method allows a DAW to adjust a variable tempo of an audio file independent of a global tempo. The method includes causing the display of a musical arrangement having a global tempo. The musical arrangement includes an audio file having a variable tempo which is independent of the global tempo. The method includes adjusting the variable tempo of the audio file, wherein the variable tempo begins at an initial tempo and adjusts to an end tempo over a set length of time. The method can also include outputting the audio file having the variable tempo in response to a command to play the musical arrangement.

21 Claims, 4 Drawing Sheets

U.S. PATENT DOCUMENTS

| | | | | |
|---|---|---|---|---|
| 2008/0034948 | A1* | 2/2008 | Sumita | 84/636 |
| 2008/0092722 | A1* | 4/2008 | Kobayashi | 84/661 |
| 2008/0097633 | A1* | 4/2008 | Jochelson et al. | 700/94 |
| 2008/0245215 | A1* | 10/2008 | Kobayashi | 84/661 |
| 2008/0249645 | A1* | 10/2008 | Nagiyama | 700/94 |
| 2008/0254946 | A1* | 10/2008 | Pauws et al. | 482/8 |
| 2008/0257134 | A1* | 10/2008 | Oppenheimer | 84/609 |
| 2009/0056525 | A1* | 3/2009 | Oppenheimber | 84/609 |
| 2009/0063414 | A1* | 3/2009 | White et al. | 707/3 |
| 2009/0063971 | A1* | 3/2009 | White et al. | 715/716 |
| 2009/0255395 | A1* | 10/2009 | Humphrey | 84/470 R |
| 2010/0011939 | A1* | 1/2010 | Nakadai et al. | 84/611 |
| 2010/0017034 | A1* | 1/2010 | Nakadai et al. | 700/258 |
| 2010/0175539 | A1* | 7/2010 | Silbert et al. | 84/612 |
| 2010/0186576 | A1* | 7/2010 | Kobayashi | 84/612 |
| 2010/0198760 | A1* | 8/2010 | Maddage et al. | 706/12 |
| 2010/0251877 | A1* | 10/2010 | Jochelson et al. | 84/609 |

OTHER PUBLICATIONS

Digidesign User Conference, "Elastic Time Varispeed Tape Speed Variation Issues," Digidesign, Daly City, CA, available at http://duc.digidesign.com/showthread.php?t=225298, last visited Sep. 23, 2009.

* cited by examiner

ADJUSTING A VARIABLE TEMPO OF AN AUDIO FILE INDEPENDENT OF A GLOBAL TEMPO USING A DIGITAL AUDIO WORKSTATION

FIELD

The following relates to computing devices capable of and methods for arranging music, and more particularly to approaches for adjusting a variable tempo of an audio file independent of a global tempo in a digital audio workstation.

BACKGROUND

Artists can use software to create musical arrangements. This software can be implemented on a computer to allow an artist to write, record, edit, and mix musical arrangements. Typically, such software can allow the artist to arrange files on musical tracks in a musical arrangement. A computer that includes the software can be referred to as a digital audio workstation (DAW). The DAW can display a graphical user interface (GUI) to allow a user to manipulate files on tracks. The DAW can display each element of a musical arrangement, such as a guitar, microphone, or drums, on separate tracks. For example, a user may create a musical arrangement with a guitar on a first track, a piano on a second track, and vocals on a third track. The DAW can further break down an instrument into multiple tracks. For example, a drum kit can be broken into multiple tracks with the snare, kick drum, and hi-hat each having its own track. By placing each element on a separate track a user is able to manipulate a single track, without affecting the other tracks. For example, a user can adjust the volume or pan of the guitar track, without affecting the piano track or vocal track. As will be appreciated by those of ordinary skill in the art, using the GUI, a user can apply different effects to a track within a musical arrangement. For example, volume, pan, compression, distortion, equalization, delay, and reverb are some of the effects that can be applied to a track.

Typically, a DAW works with two main types of files: MIDI (Musical Instrument Digital Interface) files and audio files. MIDI is an industry-standard protocol that enables electronic musical instruments, such as keyboard controllers, computers, and other electronic equipment, to communicate, control, and synchronize with each other. MIDI does not transmit an audio signal or media, but rather transmits "event messages" such as the pitch and intensity of musical notes to play, control signals for parameters such as volume, vibrato and panning, cues, and clock signals to set the tempo. As an electronic protocol, MIDI is notable for its widespread adoption throughout the industry.

Using a MIDI controller coupled to a computer, a user can record MIDI data into a MIDI track. Using the DAW, the user can select a MIDI instrument that is internal to a computer and/or an external MIDI instrument to generate sounds corresponding to the MIDI data of a MIDI track. The selected MIDI instrument can receive the MIDI data from the MIDI track and generate sounds corresponding to the MIDI data which can be produced by one or more monitors or speakers. For example, a user may select a piano software instrument on the computer to generate piano sounds and/or may select a tenor saxophone instrument on an external MIDI device to generate saxophone sounds corresponding to the MIDI data. If MIDI data from a track is sent to an internal software instrument, this track can be referred to as an internal track. If MIDI data from a track is sent to an external software instrument, this track can be referred to as an external track.

Audio files are recorded sounds. An audio file can be created by recording sound directly into the system. For example, a user may use a guitar to record directly onto a guitar track or record vocals, using a microphone, directly onto a vocal track. As will be appreciated by those of ordinary skill in the art, audio files can be imported into a musical arrangement. For example, many companies professionally produce audio files for incorporation into musical arrangements. In another example, audio files can be downloaded from the Internet. Audio files can include guitar riffs, drum loops, and any other recorded sounds. Audio files can be in sound digital file formats such as WAV, MP3, M4A, and AIFF. Audio files can also be recorded from analog sources, including, but not limited to, tapes and records.

Using the DAW, a user can make tempo changes to a musical composition. The tempo changes affect MIDI tracks and audio tracks differently. In MIDI files, tempo and pitch can be adjusted independently of each other. For example, a MIDI track recorded at 100 bpm (beats per minute) can be adjusted to 120 bpm without affecting the pitch of samples played by the MIDI data. This occurs because the same samples are being triggered by the MIDI data at a faster rate by a clock signal. However, tempo changes to an audio file inherently adjust the pitch of the file as well. For example, if an audio file is sped up, the pitch of the sound goes up. Conversely, if an audio file is slowed, the pitch of the sound goes down. Conventional DAWs can use a process known as time stretching to adjust the tempo of audio while maintaining the original pitch. This process requires analysis and processing of the original audio file. Those of ordinary skill in the art will recognize that various algorithms and methods for adjusting the tempo of audio files while maintaining a consistent pitch can be used.

Conventional DAWs are limited in that a musical arrangement typically has a global tempo. In a conventional DAW, MIDI and audio files follow this global tempo. Conventional DAWs do not provide an audio file having a variable tempo that is independent of the global tempo of the musical arrangement. Similarly, conventional DAWs do not provide a graphical interface to set an initial tempo, end tempo, and/or set length of time for adjustment of the variable tempo of an audio file in the musical arrangement having the global tempo.

SUMMARY

A computer implemented method allows a user to adjust a variable tempo of an audio file independent of a global tempo of a musical arrangement. The method can include causing the display of a musical arrangement having a global tempo. The musical arrangement can include an audio file having a variable tempo which is independent of the global tempo. The method can then include adjusting the variable tempo of the audio file so that the variable tempo begins at an initial tempo and adjusts to an end tempo over a set length of time. In some embodiments, either the initial tempo or end tempo is equal to the global tempo.

Many other aspects and examples will become apparent from the following disclosure.

BRIEF DESCRIPTION OF THE DRAWINGS

In order to facilitate a fuller understanding of the exemplary embodiments, reference is now made to the appended drawings. These drawings should not be construed as limiting, but are intended to be exemplary only.

DETAILED DESCRIPTION

The functions described as being performed at various components can be performed at other components, and the various components can be combined and/or separated. Other modifications also can be made.

Thus, the following disclosure ultimately will describe systems, computer readable media, devices, and methods for adjusting a variable tempo of an audio file independent of a global tempo in a musical arrangement using a digital audio workstation. Many other examples and other characteristics will become apparent from the following description.

Figure 1:
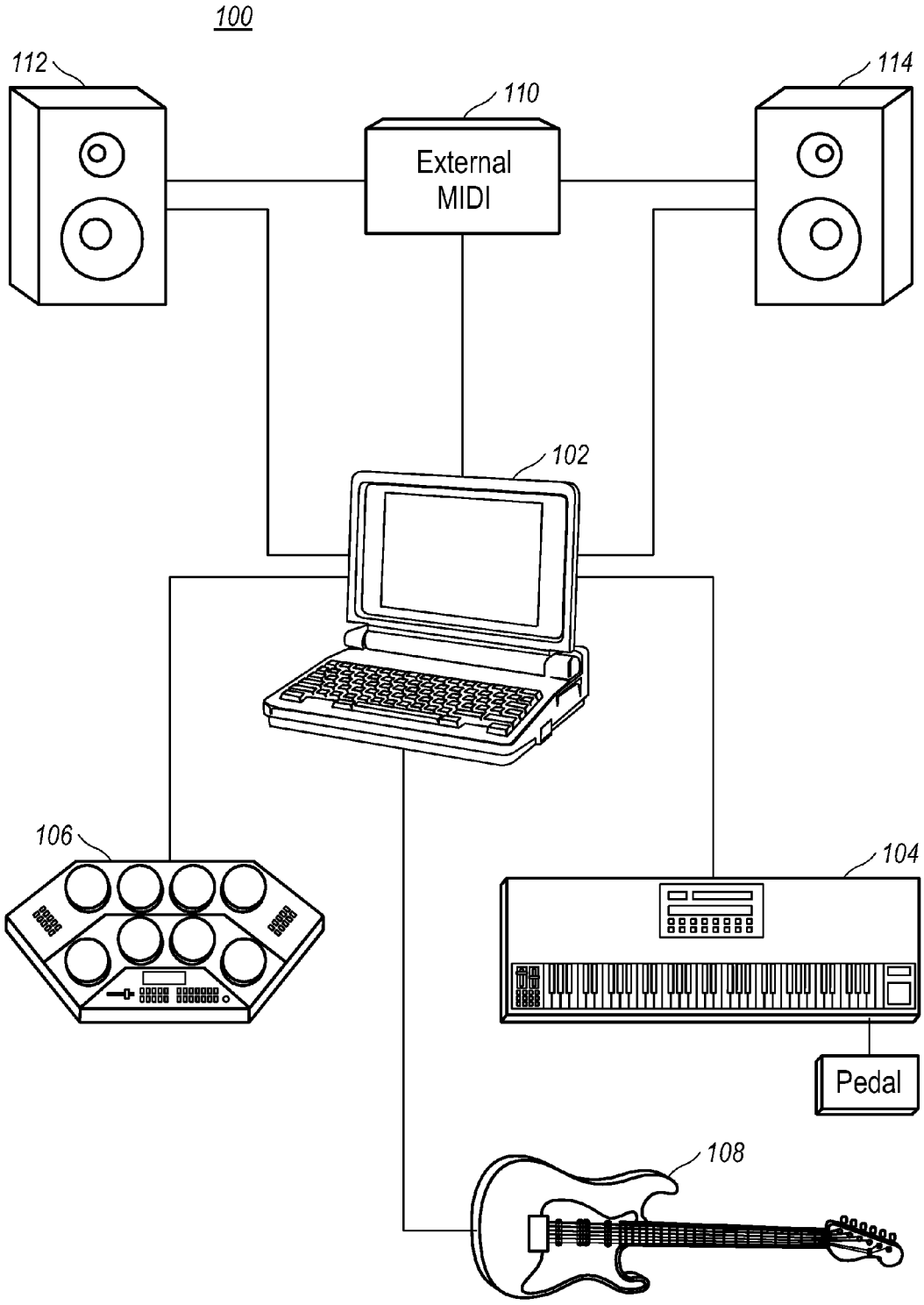
FIG. 1 depicts a block diagram of a system having a DAW musical arrangement in accordance with an exemplary embodiment.

Referring to FIG. 1, a block diagram of a system including a DAW in accordance with an exemplary embodiment is illustrated. As shown, the system 100 can include a computer 102, one or more sound output devices 112, 114, one or more MIDI controllers (e.g. a MIDI keyboard 104 and/or a drum pad MIDI controller 106), one or more instruments (e.g. a guitar 108, and/or a microphone (not shown)), and/or one or more external MIDI devices 110. As would be appreciated by one of ordinary skill in the art, the musical arrangement can include more or less equipment as well as different musical instruments.

The computer 102 can be a data processing system suitable for storing and/or executing program code, e.g., the software to operate the GUI which together can be referred to as a DAW. The computer 102 can include at least one processor, e.g., a first processor, coupled directly or indirectly to memory elements through a system bus. The memory elements can include local memory employed during actual execution of the program code, bulk storage, and cache memories that provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters. In one or more embodiments, the computer 102 can be a desktop computer or a laptop computer.

A MIDI controller is a device capable of generating and sending MIDI data. The MIDI controller can be coupled to and send MIDI data to the computer 102. The MIDI controller can also include various controls, such as slides and knobs that can be assigned to various functions within the DAW. For example, a knob may be assigned to control the pan on a first track. Also, a slider can be assigned to control the volume on a second track. Various functions within the DAW can be assigned to a MIDI controller in this manner. The MIDI controller can also include a sustain pedal and/or an expression pedal. These can affect how a MIDI instrument plays MIDI data. For example, holding down a sustain pedal while recording MIDI data can cause an elongation of the length of the sound played if a piano software instrument has been selected for that MIDI track.

As shown in FIG. 1, the system 100 can include a MIDI keyboard 104 and/or a drum pad controller 106. The MIDI keyboard 104 can generate MIDI data which can be provided to a device that generates sounds based on the received MIDI data. The drum pad MIDI controller 106 can also generate MIDI data and send this data to a capable device which generates sounds based on the received MIDI data. The MIDI keyboard 104 can include piano style keys, as shown. The drum pad MIDI controller 106 can include rubber pads. The rubber pads can be touch and pressure sensitive. Upon hitting or pressing a rubber pad, or pressing a key, the MIDI controller (104,106) generates and sends MIDI data to the computer 102.

An instrument capable of generating electronic audio signals can be coupled to the computer 102. For example, as shown in FIG. 1, an electrical output of an electric guitar 108 can be coupled to an audio input on the computer 102. Similarly, an acoustic guitar 108 equipped with an electrical output can be coupled to an audio input on the computer 102. In another example, if an acoustic guitar 108 does not have an electrical output, a microphone positioned near the guitar 108 can provide an electrical output that can be coupled with an audio input on the computer 102. The output of the guitar 108 can be coupled to a pre-amplifier (not shown) with the pre-amplifier being coupled to the computer 102. The pre-amplifier can boost the electronic signal output of the guitar 108 to acceptable operating levels for the audio input of computer 102. If the DAW is in a record mode, a user can play the guitar 108 to generate an audio file. Popular effects such as chorus, reverb, and distortion can be applied to this audio file when recording and playing.

The external MIDI device 110 can be coupled to the computer 102. The external MIDI device 110 can include a processor, e.g., a second processor which is external to the processor 102. The external processor can receive MIDI data from an external MIDI track of a musical arrangement to generate corresponding sounds. A user can utilize such an external MIDI device 110 to expand the quality and/or quantity of available software instruments. For example, a user may configure the external MIDI device 110 to generate electric piano sounds in response to received MIDI data from a corresponding external MIDI track in a musical arrangement from the computer 102.

The computer 102 and/or the external MIDI device 110 can be coupled to one or more sound output devices (e.g., monitors or speakers). For example, as shown in FIG. 1, the computer 102 and the external MIDI device 110 can be coupled to a left monitor 112 and a right monitor 114. In one or more embodiments, an intermediate audio mixer (not shown) may be coupled between the computer 102, or external MIDI device 110, and the sound output devices, e.g., the monitors 112, 114. The intermediate audio mixer can allow a user to adjust the volume of the signals sent to the one or more sound output devices for sound balance control. In other embodiments, one or more devices capable of generating an audio signal can be coupled to the sound output devices 112, 114. For example, a user can couple the output from the guitar 108 to the sound output devices.

The one or more sound output devices can generate sounds corresponding to the one or more audio signals sent to them. The audio signals can be sent to the monitors 112, 114 which can require the use of an amplifier to adjust the audio signals to acceptable levels for sound generation by the monitors 112, 114. The amplifier in this example may be internal or external to the monitors 112, 114.

Although, in this example, a sound card is internal to the computer 102, many circumstances exist where a user can utilize an external sound card (not shown) for sending and receiving audio data to the computer 102. A user can use an external sound card in this manner to expand the number of available inputs and outputs. For example, if a user wishes to record a band live, an external sound card can provide eight (8) or more separate inputs, so that each instrument and vocal can each be recorded onto a separate track in real time. Also, disc jockeys (djs) may wish to utilize an external sound card for multiple outputs so that the dj can cross-fade to different outputs during a performance.

Figure 2:
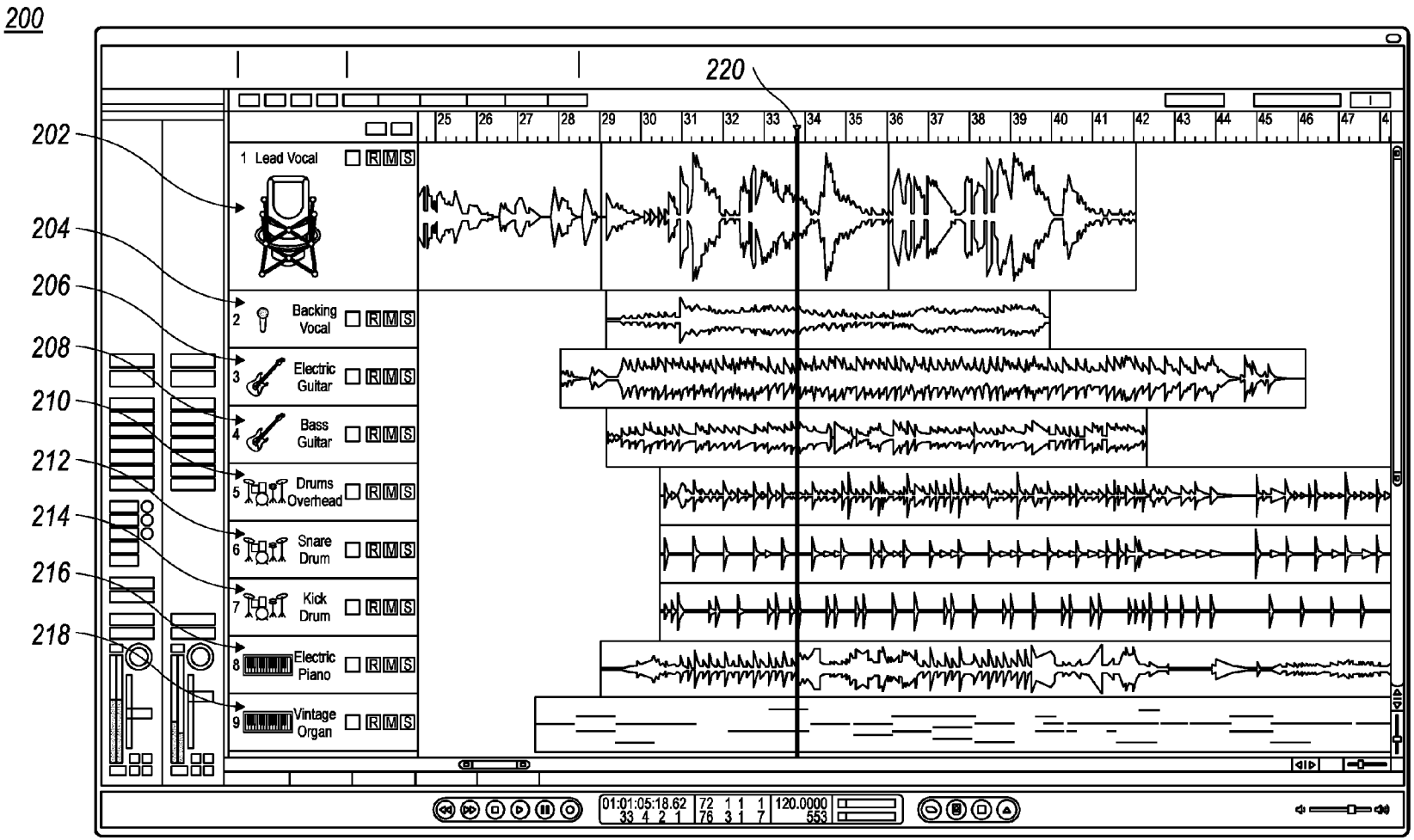
FIG. 2 depicts a screenshot of a GUI of a DAW displaying a musical arrangement including MIDI and audio tracks in accordance with an exemplary embodiment.

Referring to FIG. 2, a screenshot of a musical arrangement in a GUI of a DAW in accordance with an exemplary embodiment is illustrated. The musical arrangement 200 can include one or more tracks with each track having one or more of audio files or MIDI files. Generally, each track can hold audio or MIDI files corresponding to each individual desired instrument. As shown, the tracks are positioned horizontally. A playhead 220 moves from left to right as the musical arrangement is recorded or played. As one of ordinary skill in the art would appreciate, other tracks and playhead 220 can be displayed and/or moved in different manners. The playhead 220 moves along a timeline that shows the position of the playhead within the musical arrangement. The timeline indicates bars, which can be in beat increments. For example as shown, a four (4) beat increment in a 4/4 time signature is displayed on a timeline with the playhead 220 positioned between the thirty-third (33rd) and thirty-fourth (34th) bar of this musical arrangement. A transport bar 222 can be displayed and can include commands for playing, stopping, pausing, rewinding and fast-forwarding the displayed musical arrangement. For example, radio buttons can be used for each command. If a user were to select the play button on transport bar 222, the playhead 220 would begin to move down the timeline, e.g., in a left to right fashion.

As shown, the lead vocal track, 202, is an audio track. One or more audio files corresponding to a lead vocal part of the musical arrangement can be located on this track. In this example, a user has directly recorded audio into the DAW on the lead vocal track. The backing vocal track, 204, is also an audio track. The backing vocal track 204 can contain one or more audio files having backing vocals in this musical arrangement. The electric guitar track 206 can contain one or more electric guitar audio files. The bass guitar track 208 can contain one or more bass guitar audio files within the musical arrangement. The drum kit overhead track 210, snare track 212, and kick track 214 relate to a drum kit recording. An overhead microphone can record the cymbals, hit-hat, cow bell, and any other equipment of the drum kit on the drum kit overhead track. The snare track 212 can contain one or more audio files of recorded snare hits for the musical arrangement. Similarly, the kick track 214 can contain one or more audio files of recorded bass kick hits for the musical arrangement. The electric piano track 216 can contain one or more audio files of a recorded electric piano for the musical arrangement.

The vintage organ track 218 is a MIDI track. Those of ordinary skill in the art will appreciate that the contents of the files in the vintage organ track 218 can be shown differently because the track contains MIDI data and not audio data. In this example, the user has selected an internal software instrument, a vintage organ, to output sounds corresponding to the MIDI data contained within this track 218. A user can change the software instrument, for example to a trumpet, without changing any of the MIDI data in track 218. Upon playing the musical arrangement the trumpet sounds would now be played corresponding to the MIDI data of track 218. Also, a user can set up track 218 to send its MIDI data to an external MIDI instrument, as described above.

Each of the displayed audio and MIDI files in the musical arrangement as shown on screen 200 can be altered using the GUI. For example, a user can cut, copy, paste, or move an audio file or MIDI file on a track so that it plays at a different position in the musical arrangement. Additionally, a user can loop an audio file or MIDI file so that it is repeated, split an audio file or MIDI file at a given position, and/or individually time stretch an audio file for tempo, tempo and pitch, and/or tuning adjustments as described below.

Display window 224 contains information for the user about the displayed musical arrangement. As shown, the current tempo in bpm of the musical arrangement is set to 120 bpm. The position of playhead 220 is shown to be at the thirty-third (33rd) bar beat four (4) in the display window 224. Also, the position of the playhead 220 within the song is shown in minutes, seconds etc.

Tempo changes to a musical arrangement can affect MIDI tracks and audio tracks differently. In MIDI files, tempo and pitch can be adjusted independently of each other. For example, a MIDI track recorded at 100 bpm (beats per minute) can be adjusted to 120 bpm without affecting the pitch of the sound generators played by the MIDI data. This occurs because the same sound generators are being triggered by the MIDI data, they are just being triggered faster in time. In order to change the tempo of the MIDI file, the signal clock of the relevant MIDI data is changed. However, tempo changes to an audio file inherently adjust the pitch of the file as well. For example, if an audio file is sped up, the pitch of the sound goes up. Similarly, if an audio file is slowed, the pitch of the sound goes down.

In regards to digital audio files, one way that a DAW can change the duration of an audio file to match a new tempo is to resample it. This is a mathematical operation that effectively rebuilds a continuous waveform from its samples and then samples that waveform again at a different rate. When the new samples are played at the original sampling frequency, the audio clip sounds faster or slower. In this method, the frequencies in the sample are scaled at the same rate as the speed, transposing its perceived pitch up or down in the process. In other words, slowing down the recording lowers the pitch, speeding it up raises the pitch. Thus, using resampling, the pitch and tempo of an audio are linked.

A DAW can use a process known as time stretching to adjust the tempo of audio while maintaining the original pitch. This process requires analysis and processing of the original audio file. Those of ordinary skill in the art will recognize that various algorithms and methods for adjusting the tempo of audio files while maintaining a consistent pitch can be used.

One way that a DAW can stretch the length of an audio file without affecting the pitch is to utilize a phase vocoder. The first step in time-stretching an audio file using this method is to compute the instantaneous frequency/amplitude relationship of the audio file using the Short-Time Fourier Transform (STFT), which is the discrete Fourier transform of a short, overlapping and smoothly windowed block of samples. The next step is to apply some processing to the Fourier transform magnitudes and phases (like resampling the FFT blocks). The third step is to perform an inverse STFT by taking the inverse Fourier transform on each chunk and adding the resulting waveform chunks.

The phase vocoder technique can also be used to perform pitch shifting, chorusing, timbre manipulation, harmonizing, and other modifications, all of which can be changed as a function of time.

Another method that can be used for time shifting audio regions is known as time domain harmonic scaling. This method operates by attempting to find the period (or equivalently the fundamental frequency) of a given section of the audio file using a pitch detection algorithm (commonly the peak of the audio file's autocorrelation, or sometimes cepstral processing), and cross-fade one period into another.

The DAW can combine the two techniques (for example by separating the signal into sinusoid and transient waveforms), or use other techniques based on the wavelet transform, or artificial neural network processing, for example, for time stretching. Those of ordinary skill in the art will recognize that various algorithms and combinations thereof for time stretching audio files based on the content of the audio files and desired output can be used by the DAW.

Figure 3:
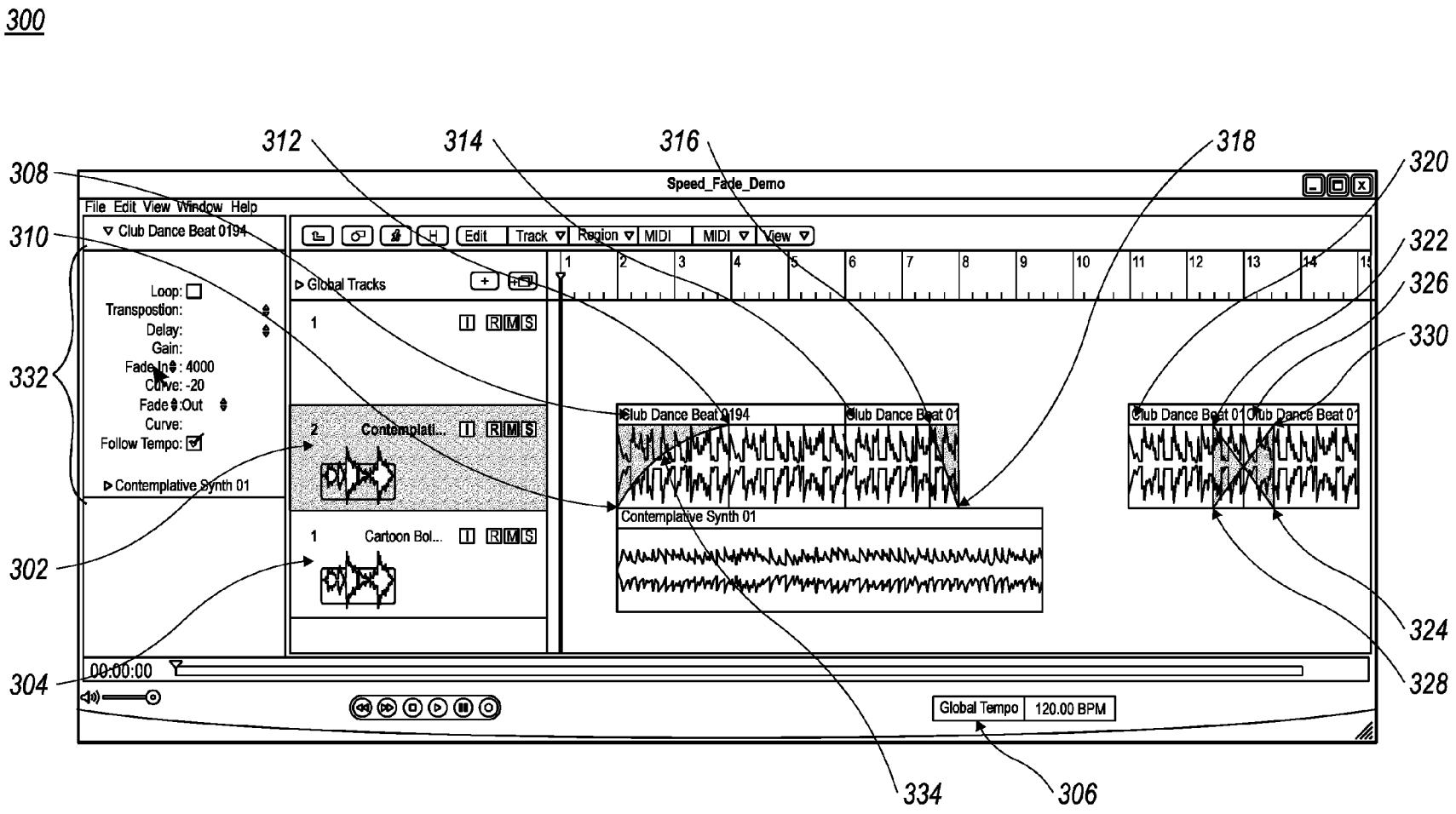
FIG. 3 depicts a screenshot of a GUI of a DAW displaying a musical arrangement including audio files, in which a first audio file has a fade-in variable tempo adjustment, a second audio file has a fade-out variable tempo adjustment, and a third and a fourth audio file having a cross-fade variable tempo adjustment in accordance with an exemplary embodiment.

FIG. 3 illustrates a screenshot of a GUI of a DAW displaying a musical arrangement including audio files, in which a first audio file has a fade-in variable tempo adjustment, a second audio file has a fade-out variable tempo adjustment, and a third and fourth audio file have a cross-fade variable tempo adjustment in accordance with an exemplary embodiment. The screenshot 300 includes a timeline for the displayed musical arrangement. Specifically, the GUI allows the user to selectively set an initial tempo, end tempo, and set time of length for a variable tempo adjustment of each displayed audio file. In the exemplary musical arrangement of FIG. 3, a second Audio Track, 302, contains four audio files related to a club dance beat. A third Audio Track, 304, contains one audio file related to a contemplative synth. The musical arrangement of FIG. 3 includes a global tempo 306, which is shown on screen 300 as 120.00 bpm. The global tempo can be modified. Those of ordinary skill in the art would recognize various methods for changing the global tempo 306, such as utilizing plus minus buttons (not shown) or manually entering a desired global tempo with computer input device such as a mouse and/or keyboard (not shown).

As shown in FIG. 3, the GUI displays an exponential fade-in curve to control the variable tempo of the first audio file 308. The exponential fade-in curve for adjusting the variable tempo includes an initial tempo 310 of 0 bpm and an end tempo 312 that is equivalent to the global tempo (120 bpm). The exponential fade-in curve for adjusting the variable tempo of the first audio file 308 has a set time length of 2 bars, beginning at bar 2 and ending at bar 4 on the timeline. Those of ordinary skill in the art would recognize that other units of time, for example seconds, can be used for the set time length of any variable tempo adjustment.

A user can set the initial tempo, end tempo, and/or set length of time by use of an input device such as a mouse. A user can select a fade tool function, e.g. selecting the function from a menu with a mouse. Then the user can drag a rubber band box, using the fade tool, over a selected area of an audio file to set the initial tempo, end tempo, and/or set length of time. Additionally, a user can modify the curve of a fade by grabbing and moving a displayed tempo adjustment line. The DAW can adjust the curve of the tempo adjustment line by curve fitting based on a selected position by a user. For example, using a mouse, a user can drag and adjust the tempo adjustment line and the DAW displays the resulting curved tempo adjustment line based on a position of the initial tempo, position of the end tempo, and position of the mouse cursor.

For example, a user can drag a box, e.g. a rubber band box, over the beginning of the first audio file to a desired variable tempo fade-in position on the first audio file. Upon creating this box, the DAW can set the initial tempo, end tempo, and/or set length of time. Additionally, a user can then further fine tune the initial tempo, end tempo, and/or set length of time. For example a user can manually enter values for a set length of time and a curvature desired for a given audio file as shown in box 332. Furthermore, a user can then adjust the tempo fade-in curve of the first audio file to be a constant rate, exponential increasing rate, or exponential decreasing rate, for example. The DAW can allow other adjustment rates and combinations thereof. In FIG. 3, the screenshot illustrates an exponential decreasing fade-in variable tempo adjustment for the first audio file. A user can adjust the fade-in rate of the variable tempo by grabbing the displayed tempo adjust line 334 and moving to adjust curvature (not shown). A user can adjust a position of the initial tempo, a position of the end tempo, and/or the set length of time by clicking and dragging a portion of the tempo adjustment line along a timeline. A DAW can allow other methods of adjusting the rate of adjustment of the variable tempo of the first audio file as well.

Upon receiving a command to play the musical arrangement, the DAW can play all files in the arrangement according to the global tempo, except the audio files that have variable tempo adjustment fades. For example, the first audio file 308 includes an exponential decreasing tempo fade-in as shown. The DAW can use a resampling algorithm, as described above, to alter the variable tempo of the first audio file. In this example, the pitch of the first audio file will start at a low value corresponding to the initial tempo and the pitch will increase until the end tempo is reached. In this example, upon reaching the end tempo, the first audio file will play at its original pitch. This can cause the DAW to play the first audio file similar to a classic tape varispeed speed-in effect. The DAW can utilize other tempo-adjusting algorithms as well.

Furthermore, as shown in FIG. 3, a user can create a linear tempo fade-out adjustment to control the variable tempo of the second audio file 314. The linear tempo fade-out adjustment includes an initial tempo 316 that is equivalent to the global tempo (120 bpm) and an end tempo 318, of 0 bpm. The linear fade-out for adjusting the variable tempo of the second audio file 314 has a set time length of 2 beats (half a bar), beginning at a second beat of bar 7 and ending at a fourth beat of bar 7. As described above, a user can modify the tempo fade-out adjustment for the second audio file 314 to be linear, exponential increasing, or exponential decreasing, for example. A user can drag a box over the end of the second audio file to create a desired fade-out tempo adjustment for the second audio file. As described above, a user can implement other methods for setting the initial tempo, end tempo, and/or set length of time for a variable tempo adjustment.

Upon receiving a command to play the musical arrangement, the DAW can play the arrangement according to the global tempo, but output the second audio file according to the variable tempo corresponding to the linear tempo fade-out as shown. The DAW can use a resampling algorithm, as described above, to alter the variable tempo of the second audio file. In this example, the pitch of the second audio file will start at an original pitch corresponding to the initial tempo and the pitch will decrease until the end tempo is reached. In this example, as approaching the end tempo, the second audio file can go down in pitch. This can cause the DAW to play the second audio file similar to a classic tape varispeed speed-down effect.

Furthermore, as shown in FIG. 3, a user can create a linear tempo cross-fade adjustment to control the variable tempo of the third audio file 320 and fourth audio file 326. The cross-fade tempo adjustment in this example is actually a linear tempo fade-out adjustment applied to the third audio file 320, overlapped with a linear tempo fade-in adjustment applied to the fourth audio file 326. The linear tempo fade-out of the third audio file includes an initial tempo 322 that is equivalent to the global tempo (120 bpm) and an end tempo 324, of 0 bpm. The linear tempo fade-in of the fourth audio file includes an initial tempo 328, of 0 bpm, and an end tempo 330 that is equivalent to the global tempo (120 bpm). The tempo fade-out of the third audio file 320, overlapped with the tempo fade-in of the fourth audio file 326 creates a tempo cross-fade.

The cross-fade of variable tempo between the third audio 320 and fourth audio file 326 file has a set time length of 1 bar (4 beats), beginning at a second beat of bar 12 and ending at a second beat of bar 13. A user can modify the tempo cross-fade adjustment between the third audio file 320 and the fourth audio file 326 to be linear, exponential increasing, or exponential decreasing, for example. The DAW can implement other patterns for adjustment for such a cross-fade tempo adjustment.

Upon receiving a command to play the musical arrangement, the DAW can play the arrangement according to the global tempo, but output the third and fourth audio file according to the variable tempo corresponding to the linear tempo cross-fade as shown for the third and fourth audio file. The DAW can use a resampling algorithm, as described above, to alter the variable tempo of the third and fourth audio file. In this example, the pitch of the third audio file will start at an original pitch corresponding to the initial tempo and the pitch will decrease until the end tempo is reached. Furthermore, in the example, the pitch of the fourth audio file will start at a low value and increase to an original pitch when the end tempo for the fourth audio file is reached. This can cause the DAW to play the third and fourth audio files with a classic tape varispeed cross-fade speed-down/speed-up effect. The DAW can perform variable tempo adjustments with any known method for adjusting tempo of an audio file.

Figure 4:
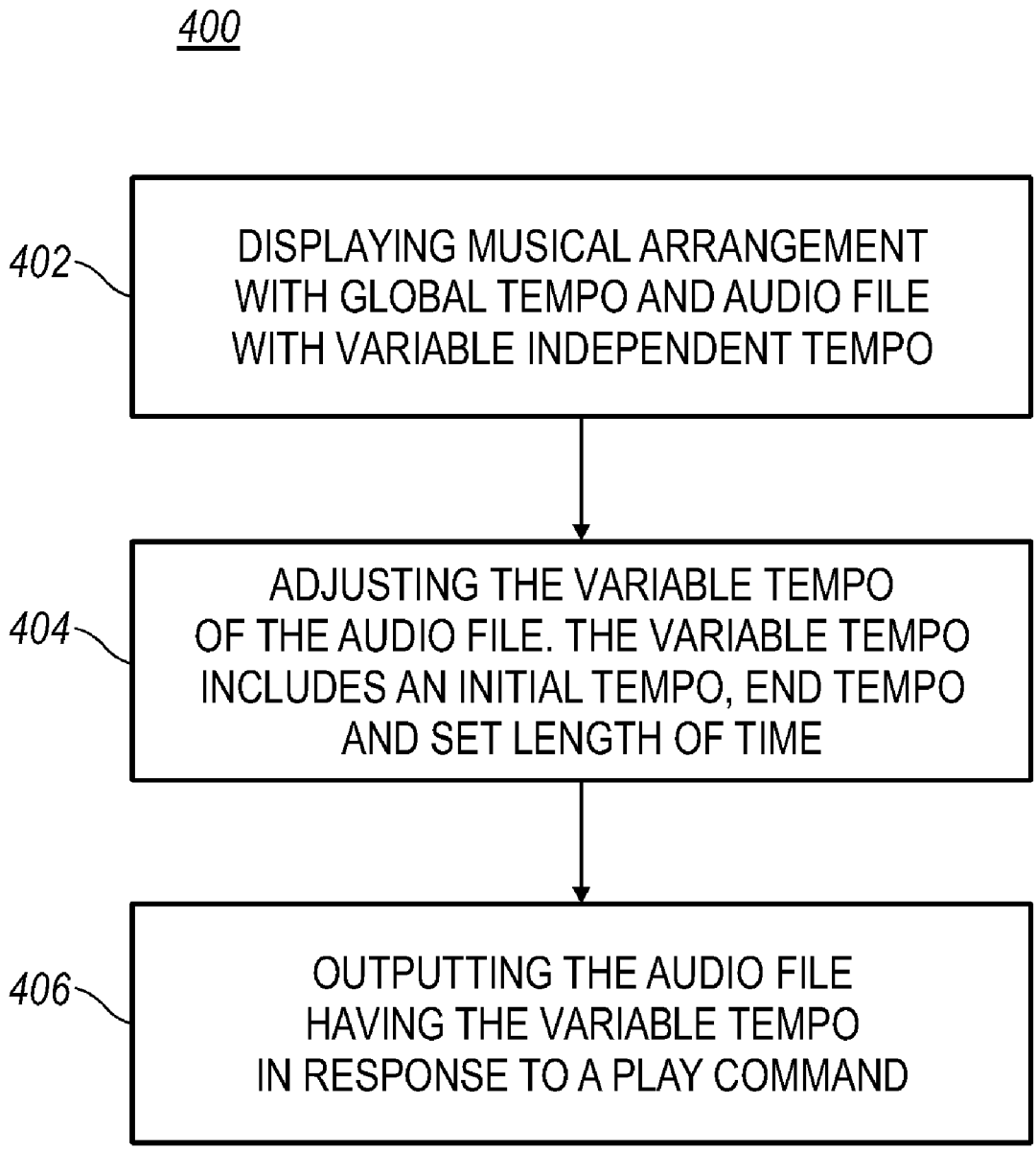
FIG. 4 illustrates a flow chart of a method for adjusting a variable tempo of an audio file independent of a global tempo of a musical arrangement in accordance with an exemplary embodiment.

Referring to FIG. 4, a flow chart of a method for adjusting a variable tempo of an audio file independent of a global tempo in a musical arrangement in accordance with an exemplary embodiment is illustrated. The exemplary method 400 is provided by way of example, as there are a variety of ways to carry out the method. In one or more embodiments, the method 400 is performed by the computer 102 of FIG. 1. The method 400 can be executed or otherwise performed by one or a combination of various systems. The method 400 described below can be carried out using the devices illustrated in FIG. 1 by way of example, and various elements of this figure are referenced in explaining exemplary method 400. Each block shown in FIG. 400 represents one or more processes, methods or subroutines carried out in exemplary method 400. The exemplary method 400 can begin at block 402.

At block 402, a musical arrangement with a global tempo and one or more audio files with a variable independent tempo is displayed. For example, the computer 102, e.g., processor, causes the display of the musical arrangement with a global tempo and the audio file with a variable independent tempo. In another example, a display module residing on a computer-readable medium can display the musical arrangement with a global tempo and the audio file with a variable independent tempo. After displaying the musical arrangement, the method 400 can proceed to block 404.

At block 404, the variable tempo of an audio file can be adjusted. The variable tempo of the audio file can include an initial tempo, an end tempo, and a set length of time for adjustment. For example, dragging a graphical box over an audio file including a variable tempo can allow a user to enter a desired initial tempo, end tempo, and/or set length of time for adjusting the tempo of the audio file, independent of the global tempo of the arrangement. In one example, the initial tempo and end tempo are pre-defined. For example an initial tempo can be pre-defined as 0 bpm and the end tempo can be pre-defined as equal to the global tempo for a tempo fade-in. For a tempo fade-out, the initial tempo can be pre-defined as equal to the global tempo and the end tempo can be pre-defined as 0 bpm. Dragging a graphical box over an intersection of two audio files can allow a user to enter a tempo cross-fade, i.e. initial tempo, end tempo, and/or set length of time for fading out one of the audio files and allow a user to enter a different initial tempo, end tempo and/or set length of time for the other audio file. These adjustments overlapping create a tempo cross-fade as described above.

A tempo adjustment can be at an exponentially decreasing rate, exponentially increasing rate, or a constant (linear) rate. The DAW can implement other rates for variable tempo adjustment of an audio file.

The processor or a processor module can display a GUI to illustrate tempo adjustments that will be applied to audio files in a musical arrangement upon receiving a play command, as shown in FIG. 3. The DAW can display these adjustments by utilizing a graphical tempo adjustment line as shown in FIG. 3. In this figure a user has set an initial tempo, end tempo (which is equal to the global tempo), and set time of length to create a fade-in tempo adjustment for a first audio file 308 at an exponentially decreasing rate. In FIG. 3 a user has set an initial tempo (which is equal to the global tempo), end tempo, and set time of length to create a fade-out tempo adjustment for a second audio file 314 at a constant (linear) rate. In FIG. 3 a user has created a cross-fade tempo adjustment between a third audio file 320 and a fourth audio file 326.

At block 406, upon receiving a play command, the method can include outputting the musical arrangement according to a global tempo and outputting each audio file including a variable tempo that is independent of the global tempo. For example, the DAW can output each audio file including a variable tempo by utilizing a resampling algorithm creating classic tape varispeed effects. In such an implementation, the pitch and tempo of each audio file including a variable tempo adjustment would be linked. The DAW can utilize other algorithms for audio tempo adjustment.

The technology can take the form of an entirely hardware embodiment, an entirely software embodiment or an embodiment containing both hardware and software elements. In one embodiment, the invention is implemented in software, which includes but is not limited to firmware, resident software, microcode, etc. Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD. Both processors and program code for implementing each as aspect of the technology can be centralized and/or distributed as known to those skilled in the art.

The above disclosure provides examples and aspects relating to various embodiments within the scope of claims, appended hereto or later added in accordance with applicable law. However, these examples are not limiting as to how any disclosed aspect may be implemented, as those of ordinary skill can apply these disclosures to particular situations in a variety of ways.

I claim:

1. A computer implemented method to adjust the tempo of an audio file using a digital audio workstation, the computer implemented method comprising, in a processor:

causing the display of a musical arrangement having a global tempo, wherein the musical arrangement includes an audio file having a variable tempo which is independent of the global tempo; and adjusting the variable tempo of the audio file, wherein the variable tempo begins at an initial tempo and adjusts to an end tempo over a set length of time.

2. The method of claim 1, further comprising outputting the audio file having the variable tempo in response to a command to play the musical arrangement.

3. The method of claim 1, wherein adjusting the variable tempo of the audio file includes resampling, so that the pitch and tempo of the audio file are linked.

4. The method of claim 1, wherein at least one of the initial tempo, the end tempo, and the set length of time is set in response to receiving a command.

5. The method of claim 1, further comprising causing the display of a graphical tempo adjustment line showing the initial tempo, the end tempo, and an adjustment between the initial tempo and end tempo.

6. The method of claim 1, wherein the adjustment between the initial tempo and end tempo occurs at one of a constant rate, an exponentially decreasing rate, and an exponentially increasing rate.

7. The method of claim 1, wherein one of the end tempo and the beginning tempo is equivalent to the global tempo.

8. A system to adjust the tempo of an audio file using a digital audio workstation, comprising:

a display device;

an input device for navigating the display; and a processor coupled to the display and the input device, the processor further adapted to:

cause the display of an arrangement having a global tempo on the display device, wherein the arrangement includes an audio file having a variable tempo which is independent of the global tempo; and adjust the variable tempo of the audio file, wherein the variable tempo begins at an initial tempo and adjusts to an end tempo over a set length of time.

9. The system of claim 8, further comprising the processor adapted to output the audio file having the variable tempo in response to a command to play the musical arrangement.

10. The system of claim 8, further comprising the processor adapted to adjust the variable tempo by resampling, so that the pitch and variable tempo of the audio file are linked.

11. The system of claim 8, wherein at least one of the initial tempo, the end tempo, and the set length of time is set in response to receiving a command.

12. The system of claim 8, further comprising the processor adapted to display a graphical tempo adjustment line.

13. The system of claim 8, wherein the processor adjusts the variable tempo of the audio file at one of a constant rate, an exponentially decreasing rate, and an exponentially increasing rate.

14. The system of claim 8, wherein one of the end tempo and the initial tempo is equivalent to the global tempo.

15. A computer program product for adjusting the tempo of an audio file using a digital audio workstation, comprising:

a computer-readable medium; and a processing module residing on the computer-readable medium and operative to:

cause the display of an arrangement having a global tempo on a display module, wherein the arrangement includes an audio file having a variable tempo which is independent of the global tempo; and adjust the variable tempo of the audio file, wherein the variable tempo begins at an initial tempo and adjusts to an end tempo over a set length of time.

16. The computer program product of claim 15, further comprising the processor module adapted to output the audio file having the variable tempo in response to a command to play the musical arrangement.

17. The computer program product of claim 15, further comprising the processor module adapted to adjust the variable tempo by resampling, so that the pitch and tempo of the audio file are linked.

18. The computer program product of claim 15, wherein at least one of the initial tempo, the end tempo, and the set length of time is set is response to receiving a command.

19. The computer program product of claim 15, further comprising the processor module adapted to cause the display of a graphical tempo adjustment line.

20. The computer program product of claim 15, further comprising the processor module adapted to adjust the tempo at one of a constant rate, an exponentially decreasing rate, and an exponentially increasing rate.

21. The computer program product of claim 15, wherein one of the end tempo and the beginning tempo is equivalent to the global tempo.

* * * * *

UNITED STATES PATENT AND TRADEMARK OFFICE

CERTIFICATE OF CORRECTION

PATENT NO. : 7,952,012 B2
APPLICATION NO. : 12/506111
DATED : May 31, 2011
INVENTOR(S) : Clemens Homburg It is certified that error appears in the above-identified patent and that said Letters Patent is hereby corrected as shown below:

In the Claims:

In column 12, line 45, in Claim 18, after “set” delete “is” and insert -- in --, therefor.

Signed and Sealed this
Twenty-ninth Day of November, 2011

David J. Kappos

David J. Kappos
*Director of the United States Patent and Trademark Office*